United States Patent [19]

Mork et al.

[11] Patent Number: 4,702,524

[45] Date of Patent: Oct. 27, 1987

[54] CONTINUOUS MINING MACHINE

[75] Inventors: Phillip W. Mork, Mukwonago; Melvin W. Kraschnewski, Racine; Carl D. Gilmore, South Milwaukee, all of Wis.

[73] Assignee: Becor Western Inc., South Milwaukee, Wis.

[21] Appl. No.: 886,890

[22] Filed: Jul. 18, 1986

[51] Int. Cl.[4] ..... E21C 47/00; B66B 17/00

[52] U.S. Cl. ..... 299/64; 299/18; 414/565

[58] Field of Search ..... 299/64, 67, 7, 18; 414/565, 566, 567, 133

[56] References Cited

U.S. PATENT DOCUMENTS

| | | | |
|---|---|---|---|
| 600,583 | 3/1898 | Jones | 414/565 |
| 991,083 | 5/1911 | Perry | 299/7 |
| 1,162,607 | 11/1915 | Hoar | 414/565 |
| 1,825,258 | 9/1931 | Barber | 37/192 R |
| 1,965,000 | 7/1934 | Porter | 414/565 X |
| 2,276,333 | 3/1942 | Ovestrud | 83/93 |
| 3,040,918 | 6/1962 | Schwartz et al. | 214/131 |
| 3,047,122 | 7/1962 | Rosetz | 198/7 |
| 3,226,043 | 12/1965 | Bowman | 241/101 |
| 3,409,235 | 11/1968 | Quinn | 241/76 |
| 3,670,972 | 6/1972 | Quinn | 241/76 |
| 3,704,834 | 12/1972 | Nilsson et al. | 241/79.2 |
| 3,733,033 | 5/1973 | Cobey | 241/30 |
| 3,926,301 | 12/1975 | Herms | 198/90 |
| 3,959,897 | 6/1976 | May | 37/58 |
| 3,979,074 | 9/1976 | White et al. | 241/30 |
| 4,011,936 | 3/1977 | Hall | 198/517 |
| 4,084,751 | 4/1978 | Galis | 241/25 |
| 4,088,236 | 5/1978 | Moore | 414/565 |
| 4,196,800 | 4/1980 | Hall | 198/318 |
| 4,486,049 | 12/1984 | Lubrich et al. | 299/7 |
| 4,571,145 | 2/1986 | Hunter | 414/567 |
| 4,615,491 | 10/1986 | Batch et al. | 241/207 X |

FOREIGN PATENT DOCUMENTS

| | | | |
|---|---|---|---|
| 1189486 | 6/1985 | Canada | 214/26 |
| 560030 | 5/1935 | Fed. Rep. of Germany . | |
| 2041803 | 2/1972 | Fed. Rep. of Germany . | |
| 387439 | 5/1908 | France . | |
| 2034844 | 3/1979 | France . | |
| 220880 | 8/1924 | United Kingdom . | |
| 287218 | 3/1928 | United Kingdom . | |
| 1355081 | 5/1974 | United Kingdom . | |

OTHER PUBLICATIONS

Pages 82–86 of an Article in the E/MJ publication dated Oct., 1966 Entitled, "Mobile Crushers: New Pit Concept".

Pages 73–75 of an Article in the E/MJ publicated dated Aug., 1968 Entitled, "Low-profile Mobile Crushing Plants".

Six Pages Reprinted from Oct., 1968 Rock Products by B. I. Kochanowsky Entitled, "Mobile Crushers Up Production, Diminish Costs".

A Three-page Photocopy of the South African Institution of Mechanical Engineers One Day Symposium Entitled, "Material Handling in Open Cast Mining" dated Sep. 18, 1980.

*Primary Examiner*—James A. Leppink
*Assistant Examiner*—David J. Bagnell
*Attorney, Agent, or Firm*—Quarles & Brady

[57] ABSTRACT

A continuing mining machine wherein a crusher is placed inboard of the machine and has a dipper mechanism as well as a loading chute. The dipper is of a twin handle type so that it can straddle a feeder chute thus affording a wide area for excavating. The placement of the crusher in a central location within the machine allows for stability and obviates the need for swivelling of the crusher during operation of the machine.

8 Claims, 4 Drawing Figures

CONTINUOUS MINING MACHINE

BACKGROUND OF THE INVENTION

In the typical mining or quarrying operation, it is common practice to transport the overburden, mined material or stone to a crushing site where it is reduced in size. This requires a digging or blasting operation to first obtain the coarse material. It is then loaded onto trucks and transported to the crushing site. The transportation of the coarse material to the crushing site requires a large fleet of trucks as well as manpower to operate them.

One method of reducing hauling costs are mobile crushers. These are utilized to crush the coarse materials on site. The coarse materials are fed to the crushers by an excavating shovel. These materials are then moved from the crushing plant to the processing plant or an overburden pile by a conveyor.

In U.S. Pat. No. 4,486,049 there is described a mobile crusher with a hydraulic loader at its forward end. While the arrangement in this patent may obviate the need for a separate excavator or trucks to haul thematerials to the crusher, the digging mechanism is at the far outer end of the conveyor. Another disadvantage is the necessity to swivel the crusher and the need for an annular outlet conveyor.

The prior art does not provide a combined excavating and crushing apparatus for a continuous mining or quarrying operation wherein the dipper is of a large capacity and can be extended beyond the feeder conveyor as well as lowered around it so as to provide a large reach area for the machine. Neither does the prior art provide a continuous mining machine wherein a crusher is centrally mounted in the machine so as to provide a balancing weight for the unit yet avoid having to swivel the crusher.

It is an advantage of the present invention to provide an improved continous mining machine or the like which has a large reach area for the dipper.

It is another advantage of this invention to provide a continuous mining machine of the foregoing type wherein a gyratory crusher is centrally mounted in the machine for stability purposes.

It is yet another advantage of this invention to provide a continuous mining machine of the foregoing type which can be constructed from available time proven components thus reducing the cost of prototyping.

It is still another object of this invention to provide a continuous mining machine of the foregoing indicated type wherein the conveyors to and from the crusher unit are of a simplified nature.

Other features and advantages of the invention will become apparent as well as a better understanding of the invention from the descriptions following.

SUMMARY OF THE INVENTION

The present invention contemplates a continuous mining and loading machine in a movable and slewable frame structure. A dipper mechanism as well as a loading conveyor and preferably a loading chute are supported by the frame structure. A crushing mechanism is operatively positioned in the frame structure and in the manner to stabilize the weight thereof with respect to the frame structure. The crusher mechanism is preferably located in a central position within the frame structure and is preferably of a gyratory type. An unloading conveyor is positioned in a linear manner to convey crushed material to a processing or dumping site. Also preferably, the dipper mechanism is provided by twin crowd handles or dipper sticks which can straddle the feeder conveyor during excavating. In one embodiment, the dipper is supported from the moveable frame structure by a twin boom arrangement. Yet in another preferred embodiment, the twin dipper mechanism is extended and retracted by a crowd pinion and rack arrangement.

DESCRIPTION OF THE PREFERRED EMBODIMENT

Figure 1:
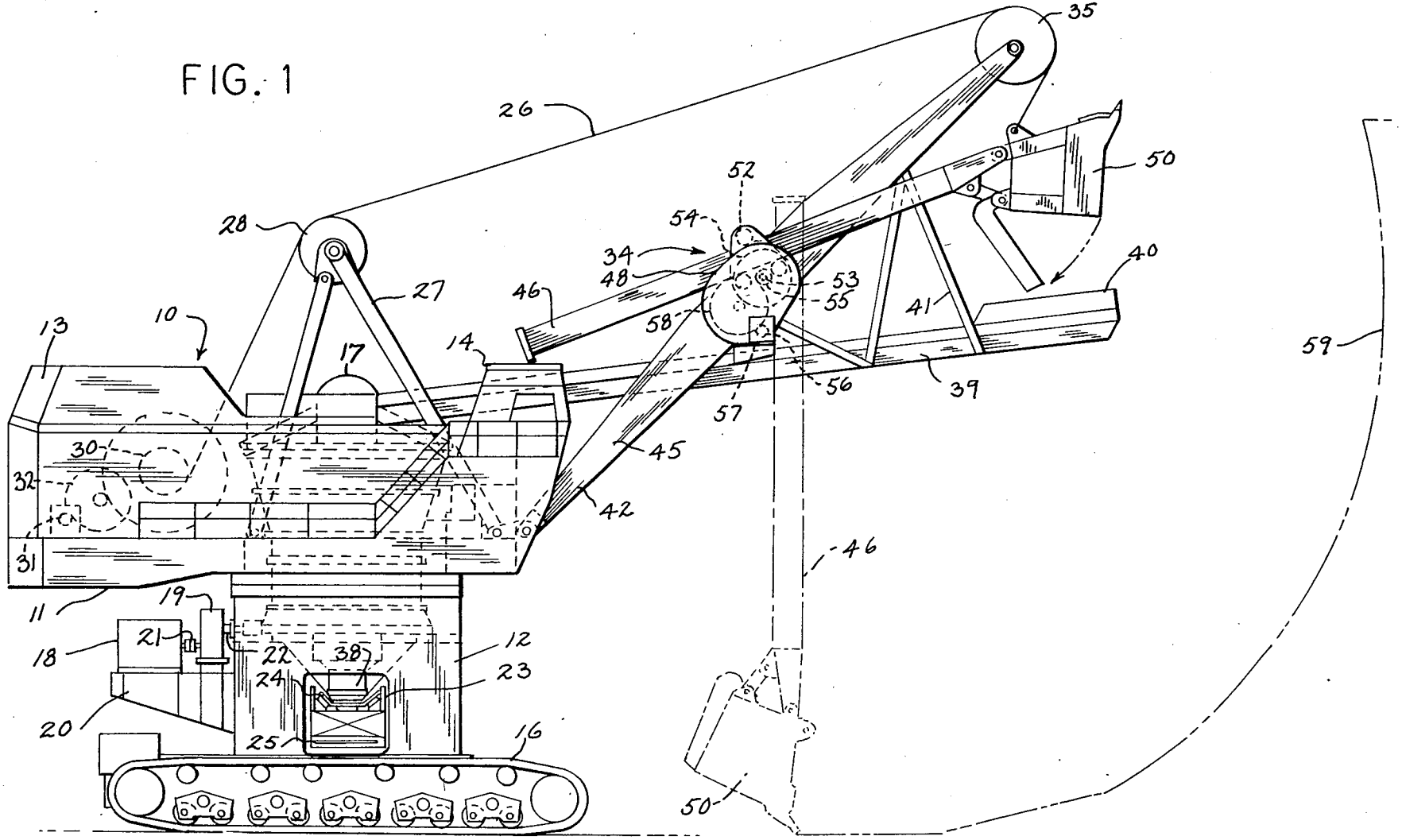
FIG. 1 is a view in side elevation of the continuous mining machine of this invention.
Figure 2:
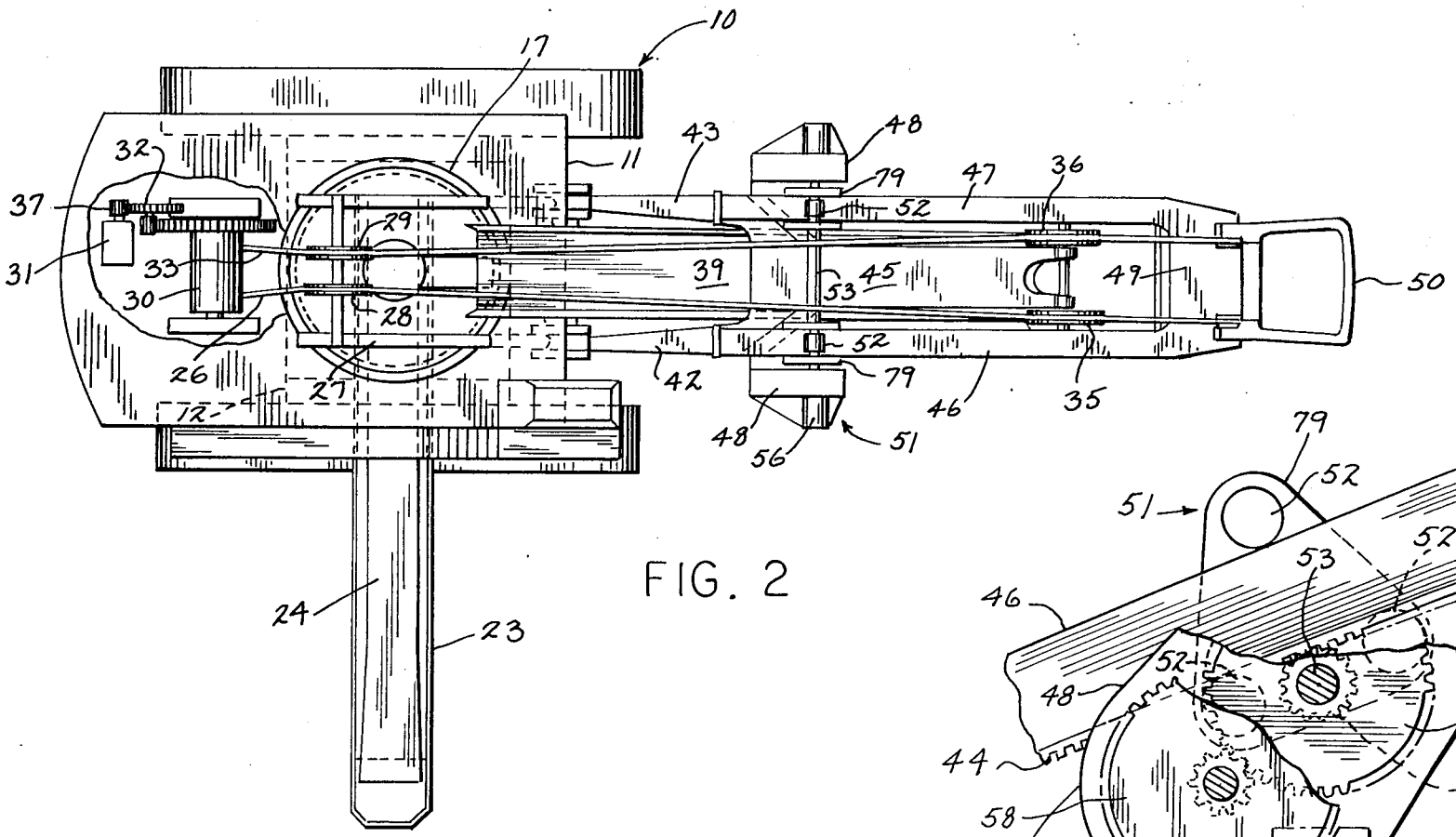
FIG. 2 is a plan view of the mining machine shown in FIG. 1.

Referring to both FIGS. 1 and 2, the mining machine generally 10 includes an upper housing 11 rotatably supported on a lower frame 12. The upper frame includes a machinery housing portion 13 as well as a cab 14. The usual crawlers 15 and 16 are also provided for moving the machine from location to location.

The crusher 17 preferably of the gyratory type is centrally positioned in the housing 11 and centrally supported on the frame 12. A crusher drive motor 18 is located on a lateral support structure 20 and drives the crusher 17 by means of the gear reducer 19 and the usual drive couplings 21 and 22. An outlet conveyor 23 is disposed in the lower frame 12 and in communication with the outlet 38 of the crusher 17. The outlet conveyor 23 has an upper load side 24 and a lower return side 25. Two sheaves 28 and 29 (See FIG. 2) are rotatably supported on the usual A-frame structure 27. These support the ropes 26 and 33 which are wound or payed out by the hoist drum 30. The motor 31 with a drive gear 37 drives the gear 32 which in turn drives the drum 30.

The boom 45 is pivotally attached to the upper rotatable housing 11 by the boom feet 42 and 43 which will straddle the conveyor 39. It supports the twin sheaves 35 and 36 which in turn receive ropes 26 and 33. These ropes are ultimately attached to the dipper 50. Also supported from the boom 45 is a frame 41 connected to the feeder conveyor 39. A hopper 40 is also provided for feeding the conveyor 39.

Supported on the boom 45 is the twin crowd assembly generally 34. It includes the crowd handles 46 and 47 each having a crowd rack such as 44 (See FIG. 3). A connecting section 49 extends between the crowd handles 46 and 47 and pivotally supports the dipper 50. The crowd handles 46 and 47 are extendably and retractably supported through an opening in the boom 45 by a drive and saddle block arrangement generally 51 which is suitably supported by the boom 45. As each drive and saddle block is the same for each of the crowd handles 46 and 47 only one is described in conjunction with FIG. 3. Each drive and saddle block arrangement 51 includes the saddle block 79 with the guide rollers 52 positioned in a triangular configuration therebetween.

Figure 3:
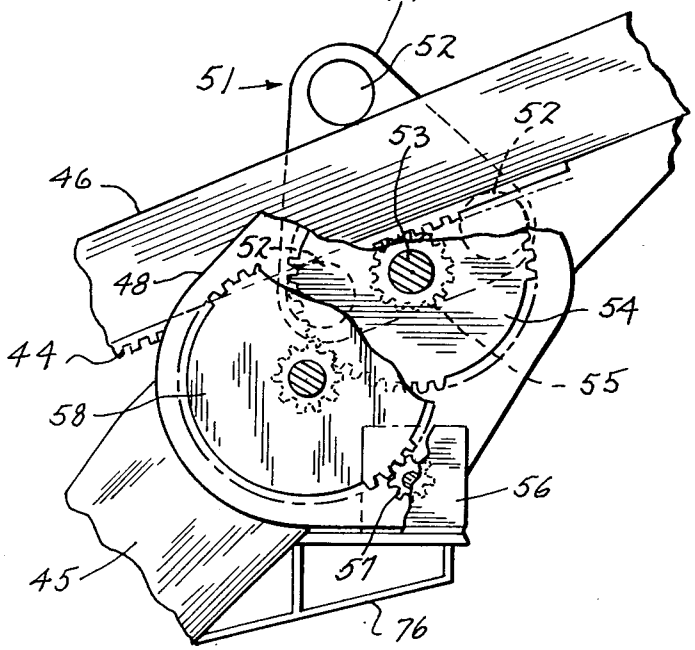
FIG. 3 is an enlarged view in side elevation and with portions broken away illustrating the gearing arrangement for driving the crowd assembly in the embodiment of FIG. 1.

A shipper shaft 53 provides a pivoting of the crowd handles 46 and 47 as well as a means for providing for extension and retraction thereof. Referring specifically to FIG. 3, it is seen that a motor 56 with a drive gear 57 engages the gear 58 which in turn engages the gear 54 to drive the pinions 55 on the shipper shaft 53 for engagement with the crowd rack 44 on the handle 46 as well as a similar crowd rack on the handle 47. The previously referred to gears and shipper shaft are supported by the frames 48 and saddle blocks 79 which in turn are supported by the boom 45. Similarly a support 76 is provided for the motors 56.

The use of the twin crowd assembly 34 in conjunction with the conveyor 39 and chute 40 affords a very extensive reach for the dipper 50 during excavation. Not only can the dipper be extended outwardly in front of the feeder hopper 40 for a distance of at least 20 feet, the dipper 50 can also be raised a substantial distance for excavating a bank 59. For example, the continuous mining machine 10 can have the dipper 50 raised to a height of 75 feet without undue stress.

Figure 4:
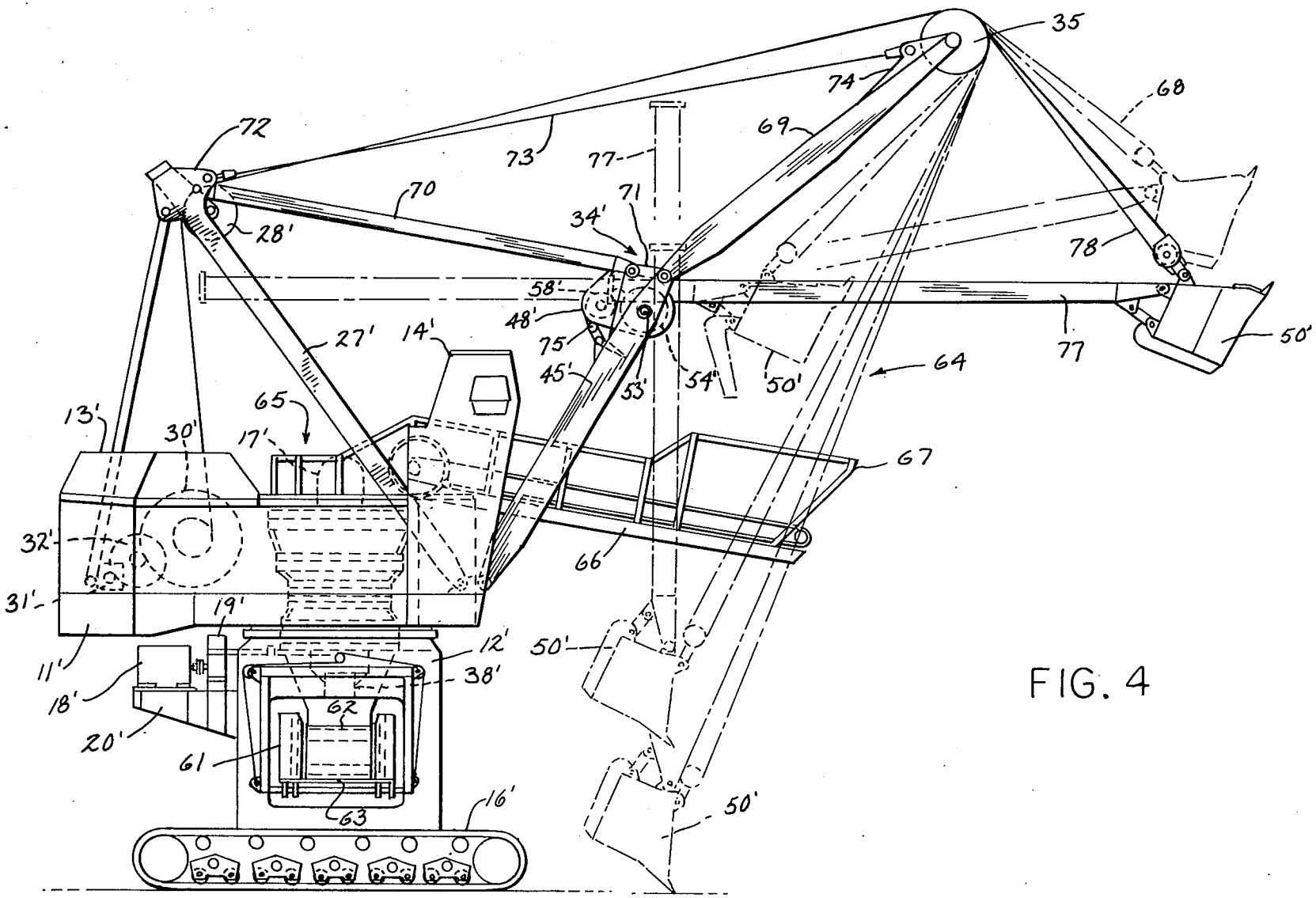
FIG. 4 is a view similar to FIG. 1 showing an alternative embodiment.

The continuous mining machine 10 has been described for use with boom 45 which is of a one piece construction. If desired, a boom could be constructed in two parts. This is described in conjunction with the embodiment generally 64 shown in FIG. 4. Similar components are identified by the same numbers as previously described in conjunction with embodiment 10 except they are shown as primed. The twin booms are identified as 45' and 69 and although not shown will have the dual feet as described previously with respect to boom 45 and feet 42 and 43. Boom 45' will be supported by the mounting 71 interconnected by the support 70 which in turn is connected to the mounting 72 on the frame support 27. The boom 69 is connected to the mounting 71 and is supported through the cable 73 which connects to the bracket 74 and to the mounting 72 extending from the frame support 27. Another difference in the embodiment 64 is the proportionately shorter feed conveyor 66 for feeding material to the crusher 17. It also has a hopper 67 to receive material from the dipper 50. Still another difference in this embodiment 64 is the outlet conveyor 61 having a different form of load side 62 but a similar return side 63. It will be noted that a standard twin or dual type rope 78 other than a single rope 26 as depicted in conjunction with embodiment 10 is also utilized. The twin type rope 68 will be wound onto or payed out from the drum 30' which will have the usual twin type grooves for receiving the twin ropes. The twin boom 45' and 69 as described in conjunction with embodiment 64 allows the outer end of the continuous mining machine to be more vertical and allows the hopper to be positioned farther in. This would allow more space in front of the machine for digging purposes. It also allows for a larger digging range in that the dipper can reach a height of at least 90 feet without undue stress.

The drive mechanism for moving the twin crowd mechanism 34' toward and away from the cab 14' as well as allowing a pivoting thereof is similar to that described in FIG. 3 except that only a single drive source is employed. In this instance a single gear box 48' is positioned in the boom 45' by a suitable opening therein. It is supported on the shipper shaft 53'. The shipper shaft 53' is journaled in the saddle blocks 51 as previously seen in FIG. 2. Mounted in the gear box 48' is the gear 58' as well as the gear 54' to drive the shipper shaft 53' and the pinions such as 55. A torque link 75 is connected between the gear box 48' and boom 45' to prevent rotation of the gear box 48'.

A twin crowd pinion and rack assembly 34 and 64 have been illustrated for use with the continuous mining machines 10 and 64. If desired, rope type crowd assemblies could be used which are common in the industry.

A gyratory crusher 17 has been described in conjunction with the continuous mining machines 10 and 64. Any type of crusher positioned within the frame structure could be utilized as well such as a jaw or roller type. An important aspect of this invention is the fact that the crusher is located centrally so as to provide a stabilizing effect on the entire machine as well as simplify the construction of the outlet conveyor.

It will thus be seen that through the present invention there is now provided mining machinery which affords a combined excavating and crushing capacity. The machine of this invention is designed to handle large quantities of material as well as have a large range for excavating. The continuous mining machine offers all of the advantages of a typical excavating apparatus having a large capacity and reach in combination with a crusher which can remain stationary during excavation.

We claim:

1. A continuous mining machine comprising:

a movable frame;

a crusher mechanism operatively supported on the frame;

an unloading conveyor mounted on the frame to transport material from the crusher mechanism;

a housing rotatably supported on the frame about the crusher mechanism;

a loading conveyor means to deliver material to said crusher mechanism;

an excavating dipper mechanism to deliver material to said loading conveyor means; and said loading conveyor means and said excavating dipper mechanism being both mounted on said housing for rotation relative to the crusher mechanism, the weight of said crusher mechanism stabilizing the frame with respect to the loading conveyor means and the excavating dipper mechanism.

2. The invention of claim 1 wherein there is further included a loading chute operatively connected to said loading conveyor means.

3. The invention of claim 1 wherein said crusher mechanism is positioned centrally with respect to said frame structure.

4. The invention of claim 3 wherein said crusher mechanism is of the gyratory type.

5. The invention of claim 1 wherein said unloading conveyor extends in a linear manner from said movable frame.

6. The invention of claim 1 wherein said dipper mechanism is defined in part by a boom for supporting twin crowd handles.

7. The invention of claim 6 wherein said loading conveyor means is supported by said boom.

8. The invention of claim 6 wherein said boom is defined by a twin boom structure.

* * * * *